United States Patent [19]

Brown

[11] Patent Number: 4,628,621

[45] Date of Patent: Dec. 16, 1986

[54] ORTHOTIC FOR RUNNING

[75] Inventor: Dennis N. Brown, Custer, Wash.

[73] Assignee: Northwest Podiatric Laboratories, Inc., Blaine, Wash.

[21] Appl. No.: 719,479

[22] Filed: Apr. 3, 1985

[51] Int. Cl.[4] ..... A43B 13/38

[52] U.S. Cl. ..... 36/44; 36/76 C

[58] Field of Search ..... 36/43, 44, 76 C, 76 R, 36/88, 71; 428/408; 128/581, 582, 595, 614, 615, 584, 585

[56] References Cited

U.S. PATENT DOCUMENTS

| | | | |
|---|---|---|---|
| 2,644,250 | 7/1953 | Ciaio | 36/7 CC |
| 2,713,968 | 9/1939 | King . | |
| 3,416,245 | 12/1968 | Ferreira | 36/44 |
| 4,023,801 | 5/1977 | Van Auken | 428/408 X |
| 4,186,499 | 2/1980 | Massok, Jr. et al. | 36/44 |
| 4,231,169 | 11/1980 | Toyama et al. | 36/44 X |
| 4,232,457 | 11/1980 | Mosher | 36/44 |
| 4,338,734 | 7/1982 | Schwartz | 36/44 |
| 4,368,234 | 1/1983 | Palmer et al. | 428/408 X |
| 4,435,910 | 3/1984 | Marc | 36/44 |
| 4,439,934 | 4/1984 | Brown | 36/44 |
| 4,520,581 | 6/1985 | Irwin et al. | 36/44 X |

FOREIGN PATENT DOCUMENTS

| | | |
|---|---|---|
| 1489605 | 10/1977 | United Kingdom . |
| 197808 | 8/1978 | United Kingdom . |

*Primary Examiner*—Werner H. Schroeder
*Assistant Examiner*—T. Graveline
*Attorney, Agent, or Firm*—Hughes & Cassidy

[57] ABSTRACT

A rigid orthotic insert made up of a plurality of layers, bonded to one another, with each layer made of a plurality of parallel graphite fibers. Some of the layers are aligned longitudinally, while other of the layers have the fibers offset from the longitudinal axis. Thus, force loads are transmitted predominantly along length of the insert.

8 Claims, 17 Drawing Figures

ORTHOTIC FOR RUNNING

BACKGROUND OF THE INVENTION

1. Field of the Invention

The present invention relates to an orthotic insert, and more particularly for such an insert which is particularly adapted to function effectively throughout the gait cycle experienced in vigorous running in a forward direction.

2. Background Art

An orthotic insert can be either soft or hard. A hard insert is a substantially rigid member, desirably having a relatively thin vertical thickness dimension and extending from the calcaneus area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

It is believed that a clearer understanding of the background of the present invention will be achieved by first discussing generally: (a) the main components or parts of the human leg and foot and how these function relative to one another; (b) the gait cycle which a person goes through in a normal walking motion; (c) the gait cycle which the person goes through in vigorous running; and (d) the intended function of a rigid orthotic in optimizing the coordinated operation of the person's foot and leg throughout the gait cycle.

For convenience, these various topics will be discussed under appropriate subheadings.

(a) The Main Components or Parts of the Human Leg and Foot and How These Function Relative to One Another With reference to FIGS. 1–3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it enables the entire foot to be articulated upwardly and downwardly (in the motion of raising or lowering the forward part of the foot) and also to permit the entire foot 10 to be moved from side to side. However, the talus 20 is connected to the tibia 16 and fibula 18 in such a way that when the entire leg 14 rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction).

To explain further the hinge motion of the subtalar joint 36, reference is now made to FIGS. **4*a* and 4*b*. The talus 20 can be considered as a vertical board 40, and the calcaneus 22 as a horizontally extending board 42, these being hinge connected to one another along a diagonal hinge line 44, with this hinge line corresponding to the subtalar joint 36. It can be seen with reference to FIG. 4*a* that as the talus 20 is rotated inwardly about its vertical axis (i.e. the front part of the leg being rotated toward the center of the person's body), there is a corresponding rotation of the calcaneus 22 (i.e. the horizontal board 42) about a horizontal axis. It can be seen in FIG. 4*b* that an opposite (i.e. outward) rotation of the talus 20 (i.e. the vertical board 40) causes a corresponding rotation of the calcaneus 22 (i.e. the horizontal board 42) in the opposite direction to that shown in FIG. 4*a***.

This motion described with reference to FIGS. **4*a* and 4*b*** above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking mechanism of the midtarsal joint which occurs when there is an outward motion of the leg 14 and the talus 20 (outward motion meaning the rotation of the leg 14 and foot 10 about the vertical axis of the leg 14 in a manner that the knee moves outwardly from the person's body), and an opposite inward motion, respectively. When the leg 14 rotates inwardly, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

This function of the midtarsal joint will now be explained relative to FIGS. **5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45** engages the underlying support surface in a manner so as to remain generally horizontal to the support surface.

It can be seen that when the two board members 40 and 42 are in the pronated position of FIG. **5*a*, the metatarsal joint represented at 50 in FIGS. 5*a–b* is in a first position which will be presumed to be an unlocked position. In the unlocked position of FIG. 5*a*, the member 46 is not rigid with the horizontal member 42, and the forward member 46 can flex upwardly relative to the horizontal member 42. (This is the pronated position of the foot 10.) However, in the position of FIG. 5***b*, the board members 46 and 42 will be presumed to be locked to one another so that the members 42 and 46 form a unitary lever. For ease of illustration, no attempt has been made to illustrate physically the unlocking relationship of FIG. 5*a* and the locking relationship of FIG. 5*b*. Rather, the illustrations of FIGS. 5*a–b* are to show the relative movement of these components, and the locking and unlocking mechanism is presumed to exist.

(b) The Gate Cycle Which the Person Goes Through in a Normal Walking Motion

Reference is first made to FIGS. 6*a* and 6*b*. As illustrated in the graph of FIG. 6*a*, during the normal walking motion, the hip (i.e. the pelvis) moves on a transverse plane, and this movement in the gait cycle is illustrate in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*). However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to the foot by the forward part of the foot making ground contact.

With further movement from the 25% to the 75% position, the leg rotates in an opposite direction (i.e. to the outside) so that the midtarsal joint 38 becomes supinated at the 75% location of FIG. 7*a*. This locks the midtarsal joint 38 so that the person is then able to operate his or her foot as a rigid lever so as to raise up onto the ball of the foot and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) The Gait Cycle Which the Person Goes Through In Vigorous Running

The gait cycle which the person goes through in vigorous running is in some respects the same as the gait cycle for walking. However, there is a "floating" period where both of the person's feet are off the ground. Further, the length of time which the foot is on the ground is substantially shorter. For example, in the normal walking gate cycle, where the person is walking at 120 steps per minute, the foot may be on the ground for as long as 0.6 seconds. However, in running, this period of ground contact may be as short as 0.2 seconds.

Also, the force exerted by the foot against the ground can be substantially greater than experienced by the walking gate cycle. These forces could go up to as high as, or greater than, three times the person's body weight.

Another consideration is that for some runners, the heel strike is absent. Rather, the runner's foot will engage the ground surface generally at the outside middle portion of the person's foot, and the center of force or pressure will move in a pattern inwardly toward the centerline of the foot and forwardly as the person pushes off from that foot.

Overall, the stress placed on the foot would be greater than for the gait cycle of normal walking.

(d) The Intended Function of the Orthotic to Improve Operation of the Person's Foot and Leg Throughout the Gate Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly, and to thus control the subsequent motion of the foot parts or components that make up these joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components. In general, these inserts have been made of various materials, some of which are formed as laminated structures to provide a relatively rigid support for the heel and midfoot regions of the foot.

These orthotics can be formed in a variety of ways. A preferred method of forming an orthotic insert is described in the applicant's U.S. Pat. No. 3,995,002. In that method, there is formed a negative mold or slipper cast from which a positive cast of the plantar surface of the individual's foot is formed. Using this positive cast as a template, an orthotic insert is formed to underlie an area under the foot. The insert itself is fabricated by applying to the positive cast the material which is to orthotic insert. The precise configuration of the insert will depend upon the prescribed corrective measures to be taken for the individual's foot.

SUMMARY OF THE INVENTION

The present invention embodies the broad teachings of U.S. Pat. No. 4,439,934, and provides specific improvements for the same.

There is a substantially unitary orthotic insert adapted to be placed in an article of footwear, said insert having a longitudinal axis parallel to a lengthwise axis of the foot for which the insert is used, and a transverse axis. The insert comprises a rear portion adapted to underlie and engage a plantar surface of a calcaneal area of the foot. There is a forward portion adapted to underlie and engage a plantar surface of a metatarsal head area of the foot.

There is an intermediate portion connecting to and extending between the rear and forward portions to engage the plantar surface of a midfoot area of the foot. The insert has outside and inside edge portions adapted to be positioned adjacent an outside edge and an inside edge of the foot, respectively.

The insert has a laminated structure comprising a plurality of vertically stacked layers bonded to one another to form a substantially unitary structure. The laminated structure comprises a first laminate means comprising a layer having fibers which have a predominant orientation of alignment substantially aligned with the longitudinal axis, so as to provide greater resistance to bending moments along said longitudinal bending axis, and to provide less resistance to bending along the transverse axis.

There is a second laminate means comprising at least one layer having fibers which have a predominate diagonal orientation of alignment, such that said alignment has a substantial longitudinal alignment component, and a transverse alignment component no greater than the longitudinal alignment component.

The laminated structure is characterized in that the structure has an overall greater resistance to bending along the longitudinal axis relative to the transverse axis.

In the preferred form, the fibers of the second laminate means are positioned relative to the longitudinal axis at an angle greater than 0° to the longitudinal axis, and at an angle no greater than about 45° to the longitudinal axis. The fibers of the second laminate means are at an angle to the longitudinal axis of approximately one-third of a right angle in the preferred configuration.

In a further preferred embodiment, there is a third laminate means comprising a layer having fibers which have a predominant orientation of diagonal alignment. This alignment has a major alignment component parallel to the longitudinal axis, and a transverse alignment component no greater than the longitudinal alignment component. The diagonal alignment of the third laminate means is directed oppositely to that of the second laminate means.

In the preferred form, the first laminate means comprises at least one layer having a plurality of graphite fibers positioned generally parallel to the longitudinal axis. Also, in the preferred form, the second laminate means comprises graphite fibers.

AIso, in the preferred form, there is a plurality of layers comprising the first laminate means.

In a particular configuration, at least one layer of the first laminate means has an inside forward portion thereof removed, thereby creating greater resistance to bending at the rear portion and at the outside edge portion of the foot.

In accordance with another facet of the present invention, the intermediate portion of the insert is raised, relative to the rear portion and forward portion so as to deviate from a position where the insert would locate the foot in a neutral position. Thus, when a downward force is exerted on the insert, the middle portion of the insert deflects downwardly, and upon release of said force, the middle portion springs upwardly to impart an upward force to the foot.

DESCRIPTION OF THE PREFERRED EMBODIMENTS

The present invention comprises a more specific improvement of the orthotic insert described in the applicant's issued U.S. Pat. No. 4,439,934.

As described in that patent, the overall method for forming the insert is generally the same as that described in applicant's U.S. Pat. No. 3,995,002. There is first provided a negative mold, from which a positive cast (i.e. a cast resembling the structure of a person's foot) is formed. Using this positive cast as a template, an orthotic insert is formed to underlie the area of the foot from the calcaneal area forward to the first metatarsal head, including the arch area, and from there laterally to the distal side of the foot or fifth metatarsal head. The insert itself is fabricated by applying to the positive cast layers of fiber impregnated with resin. The assembled layers are then heat cured and cut to the limits of the cast.

As further discussed in the applicant's U.S. Pat. No. 4,439,934, the flexing characteristics of the insert, which are integral to its performance, can be beneficially controlled by adjusting the placement, amount and direction of graphite fibers, and in some instances, other fibers such as glass fibers. The insert so formed is extremely light weight and relatively thin in comparison to conventional orthotic inserts.

Figure 1:
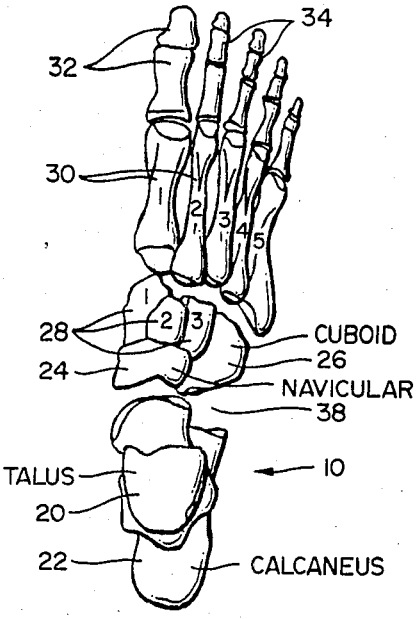
FIG. 1 is a top plan view of the right foot of a human, with certain components of the foot being separated from one another for purposes of illustration.
Figure 2:
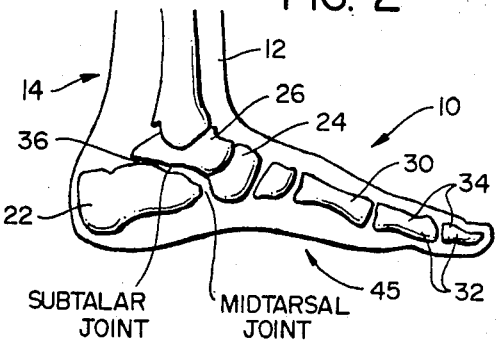
FIG. 2 is a side elevational view looking toward the inside of a person's left foot, with the outline of the foot and lower leg being shown as a shaded area.
Figure 3:
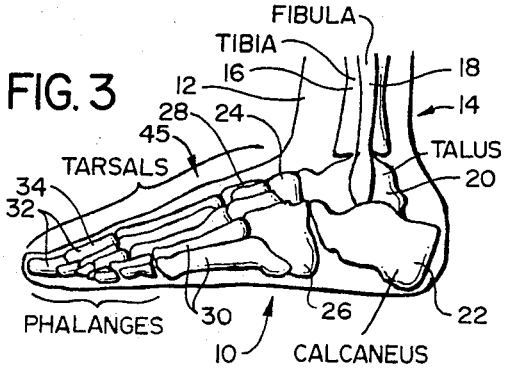
FIG. 3 is a view similar to FIG. 2, but looking toward the outside of the person's foot.
Figure 4A:
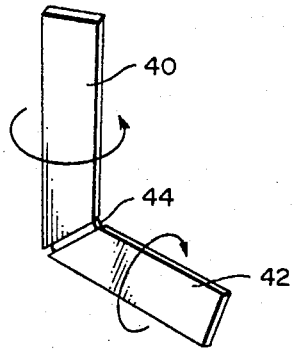
FIGS. 4*a* and 4*b* are perspective views illustrating schematically the rotational movements of the talus and calcaneus about the subtalar joint.
Figure 4B:
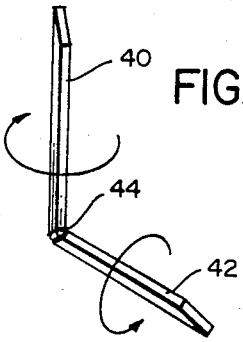
Figure 5A:
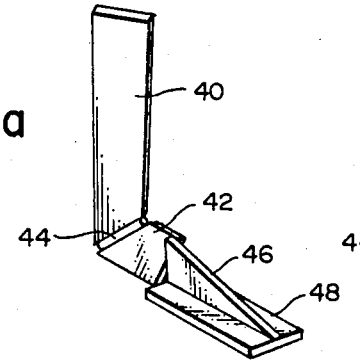
FIGS. 5*a* and 5*b* are schematic views similar to those of FIGS. 4*a–b*, but further illustrating the relative movement between the calcaneus and the midfoot about the midtarsal joint.
Figure 5B:
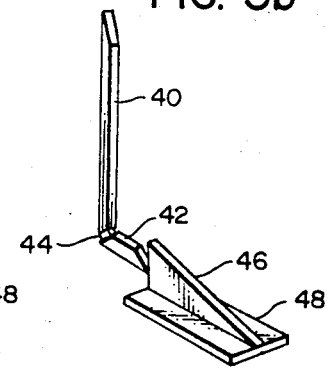
Figure 6A:
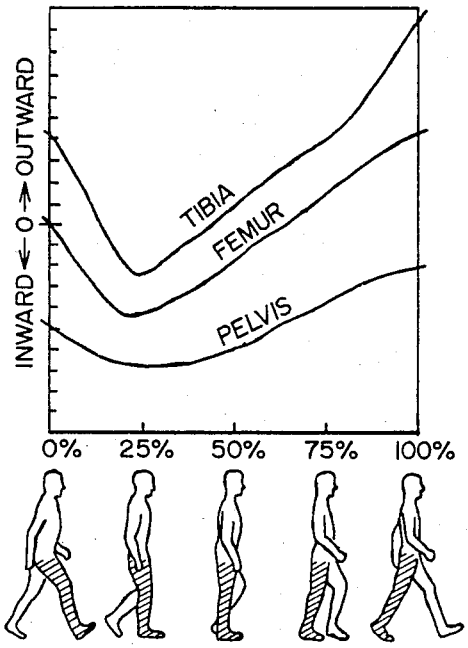
FIG. 6*a* is a graph illustrating the rotational movement of the pelvis, femur and tibia during one-half of a gait cycle.
Figure 6B:
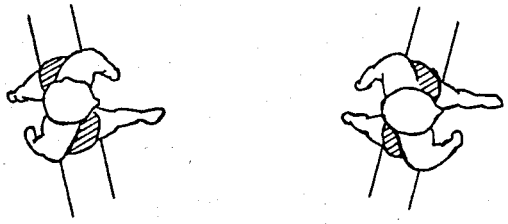
FIG. 6*b* is a top plan view illustrating the rotation of the person's pelvis during that portion of the gait cycle illustrated in FIG. 7*a;*
Figure 7A:
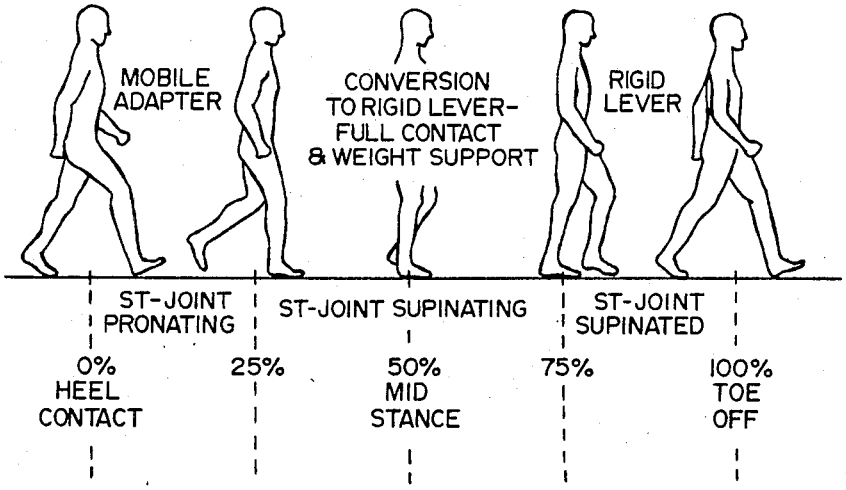
FIG. 7*a* is a graph similar to FIG. 6*a*, but illustrating the timing of the pronating and supinating motion of the leg and foot through one-half of a gait cycle.
Figure 8:
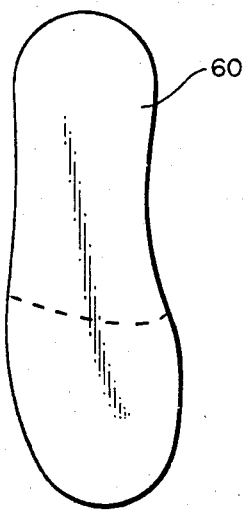
FIG. 8 is a top plan view of an upper soft portion of an orthotic device, made to fit a person's right foot.

To proceed to a more detailed description of the present invention, in FIG. 8, there is shown a two layered first blank 60 which is generally configured to the outline of a bottom of an individual's foot. This blank 60 can be of conventional configuration. For example, it can include an upper layer of a cloth material such as nylon, Dacron, cotton or the like which is abrasion resistant and absorbs perspiration well. It can further comprise a second layer of flexible rubber or neoprene or the like which is co-extensive with and adheres to the upper layer. While this first blank 60 is desirably used in the present invention, within the broader aspects of the present invention, this blank 60 is not an absolutely necessary element.

Figure 9:
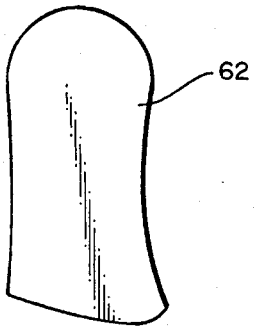
FIG. 9 is a top plan view of another portion of the orthotic insert toward which the subject matter of the present invention is particularly directed.
Figure 10:
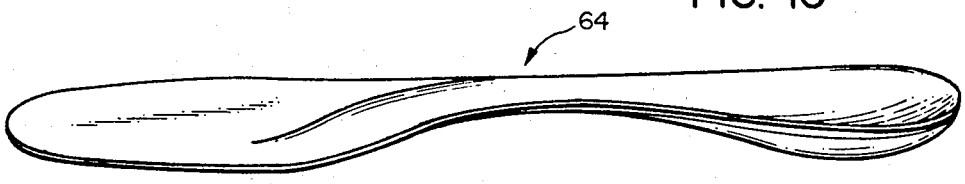
FIG. 10 is an isometric view of an insert made in accordance with the present invention.
Figure 7B:
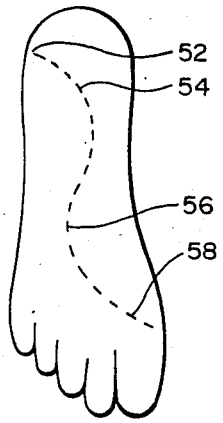
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*

In FIG. 9, there is a second blank 62 which incorporates the teachings of the present invention. In the end configuration of the present invention, this blank 62 underlies the blank 60 and is bonded thereto. The end configuration of the two blanks 60 and 62 is illustrated in FIG. 10, which is a perspective view of the end product.

In the applicant's earlier patent, U.S. Pat. No. 4,439,934, the method of forming the blank 62 was described generally. This blank 62 can be formed and contoured around a positive cast obtained using the method and apparatus disclosed in applicant's U.S. Pat. No. 3,995,002. Then various arrangements of layers of fiberglass or graphite, impregnated with resin, are laid upon the positive cast to form the second blank 62.

With respect to the novel features of the present invention, it has been found that within the broad teaching of U.S. Pat. No. 4,439,934, the orientation of certain of the fibers in the layer or layers can be selected in certain configuration to improve the performance characteristics of the orthotic insert in specific ways.

Figure 11:
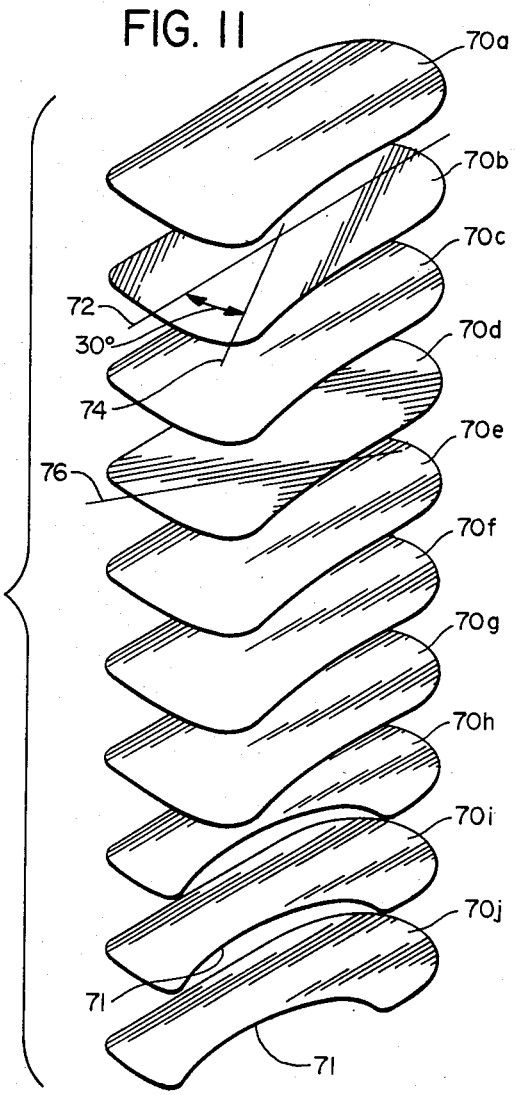
FIG. 11 is a perspective view of six laminations utilized in forming the first embodiment of the present invention to form the insert section illustrated in FIG. 9.

A first embodiment of the present invention is illustrated in FIG. 11. It can be seen that this is made up of ten layers, 70*a–j*. Each of these layers is made up of a plurality of graphite strands, with the strands of each layer being parallel to one another. The strands are impregnated with a suitable resin.

The top seven layers 70*a–g* have the same general configuration as the insert section 62. The lowermost three layers 70*h–j* also have the same general configuration as the insert section 62, except that the inside forward portion of these layers is cut away, as indicated at 71 with reference to the bottom layer 70*j*.

The second layer 70*b* has the strands of graphite extending in a diagonal line from a rear outside portion of the insert toward a forward inside portion of the insert. As shown herein, the graphite strands are desirably oriented at 30° off the longitudinal axis. In the preferred form, however, this precise orientation can vary depending upon the particular function to be accomplished. In general, the orientation of these strands indicated by the line 74 relative to the longitudinal axis 72 would be greater than 0° from the longitudinal axis 72, and generally no greater than about one-half of a right angle from the longitudinal axis 72.

The fourth layer 70*d* is generally the same as the second layer 70*b*, except that the orientation of the graphite fibers, indicated at 76, is directed along a diagonal extending from a rear inside portion to a forward outside portion. The angle of orientation of these graphite fibers of the fourth layer 70*d* would be about the same as that of the layer 70*b*, except that the angle would be on the opposite side of the longitudinal axis 72.

The remaining layers (70*a, c* and *e–j*) have the graphite fibers oriented parallel with the longitudinal axis 72.

Thus, it can be appreciated that the orientation is such that there is substantial resistance to bending moment about the longitudinal axis 72, and the resistance to bending is at a minimum along a transverse axis perpendicular to the longitudinal axis 72. Further, greater strength is provided at the heel and outside portions of the foot, relative to the forward inside portion. It has been found that this particular arrangement is quite advantageous during vigorous running where there are relatively high forces exerted against the foot.

Figure 12:
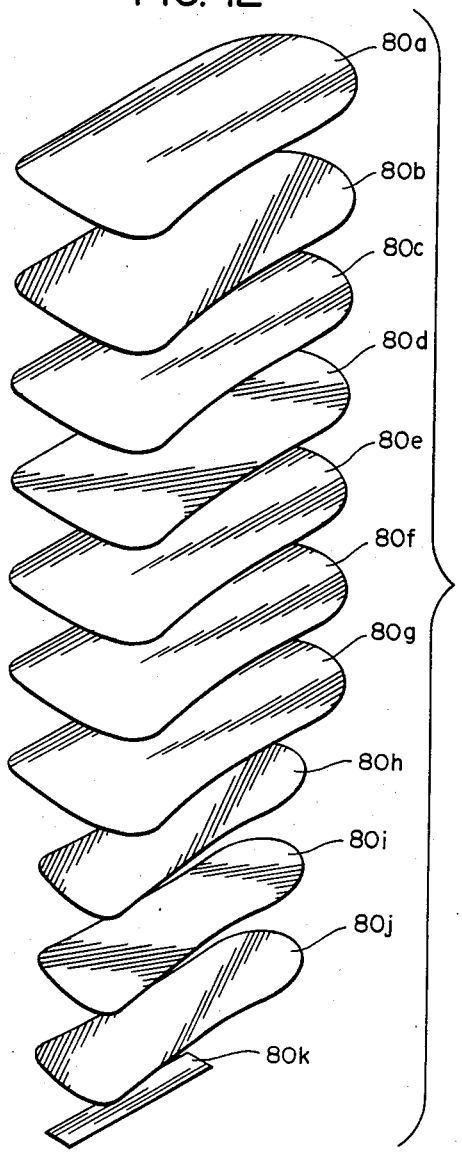
FIG. 12 is a view similar to FIG. 11, showing the laminations to form a second embodiment of the present invention which is another form of the insert section illustrated in FIG. 9.
Figure 13:
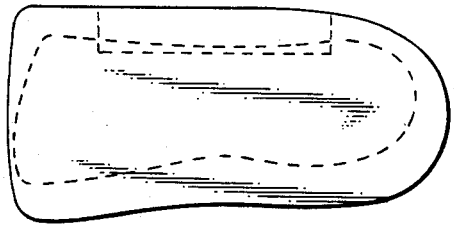
FIG. 13 is a top plan view showing the insert section resulting from the stack up of FIG. 12.

A second embodiment of the present invention is illustrated in FIG. 12. It can be seen that there are eleven layers designated 80*a–k*. The top seven layers 80*a–g* are identical to layers 70*a–g*, respectively.

Layers 80*h* and 80*i* have the graphite fibers oriented oppositely to one another, with the angles of orientation being at about 30° from the longitudinal axis, with the limits of these angles being approximately the same as those described with reference to the first embodiment. The orientation of the fibers of 80*h* is along a diagonal from a rear outside location to a forward inside location.

The layer 80*j* is substantially the same as layer 80*h*. In addition, the width dimension of the three layers 80*h–j* is made moderately smaller than the width dimension of the other layers 80*a–g*. Normally, the placement of the layers 80*h–j* would be such that these would be at the outside of the foot so as to make that portion of the foot more rigid. However, within the broader aspects of the present invention, these could be moved to a more inward location.

Finally, there is a lowermost layer 80*k*, and this is a short strip of material having graphite fibers oriented longitudinally. This is positioned at the forward outside edge portion of the insert. This adds added strength to that portion of the insert.

In each of the embodiments, the layers 70*a–j* or 80*a–k* are bonded and cured to form the unitary blank 72. More specifically, the layers are conformed to the contour of the mold, preheated for a period of time, cured at 350° F. for about 45 minutes, and then affixed to the bottom of the blank 60 to create the final insert 64.

To describe another advantageous feature of the present invention, reference is made to FIG. 10. As a preliminary comment, it should be understood that one of the inherent properties of graphite is that it has extremely fast recovery. (In other words, if the graphite structure is deflected under a force moding, then upon release of the force moding, the graphite structure will very rapidly return to its original position.)

Improved athletic performance can be accomplished instances by shaping the orthotic so that the mid area, indicated at 90, is raised moderately from the heel area 92 to the area 94 at the ball of the foot. This moderate elevation of the middle arch portion 90 is slightly greater than what would normally be the case if the orthotic were designed for conventional purposes. This repositioning would be such that the angle of the calcaneus relative to the mid-foot would be decreased moderately (e.g., up to as much as four degrees), relative to the neutral position of the foot.

Thus, when a vertical force is placed on the foot by the foot coming into ground engagement, the foot will tend to cause the raised portion of the insert to deflect downwardly moderately, something in the nature of a spring. Then, during release of this downward pressure exerted by the foot, the graphite structure of the insert would immediately spring back (i.e., tend to recover), so that it would actually exert an upward force against the person's foot, so that the insert itself would be adding to the performance of the foot. If we consider this feature relative to a high jumper, the insert would thus add to the total upward force which could be exerted by the jumper. If we were to examine this in the performance of a runner, when the foot is in its propulsive mode, there is a small increment of additional lift provided. Also, this particular device could be used for a long jumper, or any athletic movement which would require an upward lift. Further, for a specific athletic event, this configuration of the insert could be used possibly only on the takeoff foot of the athlete.

It is to be understood that within the broader scope of the embodiments shown herein, the angular variation of the fibers can be modified, depending upon the special requirements of the person's foot. Also, while the particular layup of these layers has been found to be quite advantageous, it is to be understood that certain additions or deletions could be made depending upon the particular circumstances relating to that person's foot. Also, the order or placement of the layers could be modified and still function within the general mode of operation of the present invention.

I claim:

1. A substantially unitary orthotic insert adapted to be placed in an article of footwear, said insert having a longitudinal axis parallel to a lengthwise axis of a foot for which the insert is used, and a transverse axis, with the foot having a plantar surface, which has a calcaneal area, a metatarsal head area, and a mid-foot area, said insert comprising:

a. a rear portion adapted to underlie and engage the plantar surface of the calcaneal area of the foot;

b. a forward position adapted to underlie and engage the plantar surface of the metatarsal head area of the foot;

c. an intermediate portion connecting to and extending between said rear and forward portions to engage the plantar surface of the mide-foot area of the foot;

d. said insert having outside and inside edge portions adapted to be positioned adjacent an outside edge and an inside edge of the foot, respectively;

e. said insert having a laminated structure comprising a plurality of vertically stacked layers bonded to one another to form a substantially unitary structure, said laminated structure comprising:

1. a first laminate means comprising a layer having fibers which have a predominant orientation of alignment substantially aligned with the longitudinal axis, so as to provide greater resistance to bending moments along said longitudinal bending axis, and to provide less resistance to bending along the transverse axis;

2. a second laminate means comprising at least one layer having fibers which have a predominant diagonal orientation of alignment, such that said alignment has a substantial longitudinal alignment component, and a transverse alignment component no greater than the longitudinal alignment component;

f. said laminated structure being characterized in that said structure has an overall greater resistance to bending along said longitudinal axis, relative to said transverse axis.

2. The insert as recited in claim 1, wherein the fibers of said second laminate means are positioned relative to said longitudinal axis at an angle greater than 0° to said longitudinal axis, and at an angle no greater than about 45° to said longitudinal axis.

3. The insert as recited in claim 2, wherein the fibers of said second laminate means are at an angle to the longitudinal axis of approximately one-third of a right angle.

4. The insert as recited in claim 1, wherein there is third laminate means comprising a layer having fibers which have a predominant orientation of diagonal alignment, said alignment having a major alignment component parallel to the longitudinal axis, and a transverse alignment component no greater than the longitudinal alignment component, said diagonal alignment of the third laminate means being directed oppositely to that of the second laminate means.

5. The insert as recited in any of claims 1, 2, 3 or 4, wherein said first laminate means comprises at least one layer having a plurality of graphite fibers positioned generally parallel to said longitudinal axis.

6. The insert as recited in any of claims 1, 2, 3 or 4, wherein the fibers of said second laminate means comprise graphite fibers having said predominant orientation, and said first laminate means comprising at least one layer having fibers generally parallel to the longitudinal axis.

7. The insert as recited in any one of claims 1, 2, 3 or 4, wherein at least one layer of one of said first laminate means has an inside forward portion thereof removed, thereby creating greater resistance to bending at the rear portion and at the outside edge portion of the foot.

8. A substantially unitary orthotic insert adapted to be placed in an article of footwear, said insert having a longitudinal axis parallel to a lengthwise axis of a foot for which the insert is used, and a transverse axis, with the foot having a plantar surface, which has a calcaneal area, a metatarsal head area, and a mid-foot area, said insert comprising:

a. a rear portion adapted to underlie and engage the plantar surface of the calcaneal area of the foot;

b. a forward portion adapted to underlie and engage the plantar surface of the metatarsal head area of the foot;

c. an intermediate portion connecting to and extending between said rear and forward portions to engage the plantar surface of the mid-foot area of the foot;

d. said insert having outside and inside edge portions adapted to be positioned adjacent an outside edge and an inside edge of the foot, respectively;

e. said insert having a laminated structure comprising a plurality of stacked layers bonded to one another to form a substantial unitary structure, said layers comprising a plurality of graphite fibers having a substantial alignment component generally parallel to said longitudinal axis;

f. the intermediate portion of said insert being raised, relative to said rear portion and forward portion so as to deviate from a position where the insert would locate the foot in a neutral position;

whereby when a downward force is exerted on said insert, the middle portion of the insert deflects downwardly, and upon release of said force, said middle portion springs upwardly to impart an upward force to the foot.

* * * * *